US011283146B2

(12) United States Patent
Watanabe

(10) Patent No.: US 11,283,146 B2
(45) Date of Patent: Mar. 22, 2022

(54) NON-RECIPROCAL CIRCUIT ELEMENT

(71) Applicant: TDK CORPORATION, Tokyo (JP)

(72) Inventor: Yoshitsugu Watanabe, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 17/015,600

(22) Filed: Sep. 9, 2020

(65) Prior Publication Data

US 2021/0091444 A1 Mar. 25, 2021

(30) Foreign Application Priority Data

Sep. 20, 2019 (JP) ..... JP2019-172016

(51) Int. Cl.
*H01P 1/383* (2006.01)
*H01P 1/32* (2006.01)
*H01F 7/02* (2006.01)

(52) U.S. Cl.
CPC ..... *H01P 1/32* (2013.01); *H01F 7/02* (2013.01); *H01P 1/383* (2013.01)

(58) Field of Classification Search
CPC ..... H01P 1/32; H01P 1/36; H01P 1/38; H01P 1/383; H01P 1/387; H01P 1/362; H01P 1/365; H01P 1/37; H01P 1/393
USPC ..... 333/1.1, 24.2
See application file for complete search history.

(56) References Cited

U.S. PATENT DOCUMENTS 5,459,439 A * 10/1995 Marusawa ..... H01F 1/0027 333/1.1
2002/0008596 A1* 1/2002 Watanabe ..... H01P 1/387 333/1.1

FOREIGN PATENT DOCUMENTS

JP 2002141709 A 5/2002
JP 2015050689 A 3/2015

* cited by examiner

*Primary Examiner* — Stephen E. Jones
(74) *Attorney, Agent, or Firm* — Young Law Firm, P.C.

(57) ABSTRACT

Disclosed herein is a non-reciprocal circuit element that includes a substrate having lower and upper surfaces, a magnetic metal layer provided on the lower surface of the substrate, a magnetic rotator provided on the upper surface of the substrate, and a permanent magnet for applying a magnetic field to the magnetic rotator. The magnetic metal layer includes a lower yoke provided at a position overlapping the magnetic rotator in a plan view and a plurality of terminal electrodes connected to the magnetic rotator.

8 Claims, 13 Drawing Sheets

NON-RECIPROCAL CIRCUIT ELEMENT

BACKGROUND OF THE INVENTION

Field of the Invention

The present invention relates to a non-reciprocal circuit element and, more particularly, to a non-reciprocal circuit element of a surface mount type having a structure in which a magnetic rotator is mounted on a substrate.

Description of Related Art

A non-reciprocal circuit element such as an isolator or a circulator which is a kind of a magnetic device has a structure in which a necessary component such as a magnetic rotator is incorporated in a magnetic metal case functioning as a yoke. The magnetic metal case functions also as a grounding member and can thus be used as an external terminal for grounding. However, in this case, a signal input/output terminal needs to be formed separately, and a structure allowing an electrical signal to be drawn outside the magnetic metal case is required. That is, the signal input/output terminal needs to be led outside by penetrating the magnetic metal case constituting the bottom part of a product.

As a method of forming the external terminal, JP 2002-141709A states that a conductive magnetic body is insertion-molded in an insulating resin, in the course of which an external terminal is formed so as to stride over the bottom surface of the magnetic metal case in the thickness direction thereof. However, the conventional non-reciprocal circuit element described in JP 2002-141709A, in which a resin case including the external terminal is formed by insertion molding, has thus a complicated structure.

On the other hand, the non-reciprocal circuit element described in JP 2015-50689A has a structure in which a substrate mounting thereon a magnetic rotator is sandwiched by an upper yoke and a lower yoke, and a part of the lower surface of the substrate, at which a terminal electrode is formed, is exposed from the lower yoke. This makes it possible to achieve a configuration allowing the terminal electrode to be easily led outside the magnetic metal case without using the resin case or the like.

However, since the non-reciprocal circuit element described in JP 2015-50689A has a structure in which the lower yoke goes around to the lower surface of the substrate from the side surface thereof, so that it is necessary to reduce the thickness of a part of the substrate that is covered with the lower yoke and, conversely, to increase the thickness of a part of the substrate that is exposed from the lower yoke. This involves advanced machining technology for machining the substrate, making it difficult to reduce manufacturing cost.

SUMMARY

It is therefore an object of the present invention is to reduce manufacturing cost of a non-reciprocal circuit element of a surface mount type having a structure in which a magnetic rotator is mounted on a substrate by simplifying the shape of the substrate.

A non-reciprocal circuit element according to the present invention includes a substrate, a magnetic metal layer provided on the lower surface of the substrate, a magnetic rotator provided on the upper surface of the substrate, and a permanent magnet for applying a magnetic field to the magnetic rotator. The magnetic metal layer has a lower yoke provided at a position overlapping the magnetic rotator in a plan view and a plurality of terminal electrodes connected to the magnetic rotator.

According to the present invention, the magnetic metal layer provided on the lower surface of the substrate functions as the lower yoke and terminal electrodes, thus eliminating the need for the lower yoke to go around to the lower surface of the substrate from the side surface thereof. This in turn eliminates such a machining process as locally thinning the thickness of the substrate, thereby allowing reduction in manufacturing cost. In addition, the lower yoke and the terminal electrodes constitute the same plane, so that when the non-reciprocal circuit element is mounted on a motherboard, no interference occurs between the lower yoke 147 and the motherboard.

In the present invention, the magnetic metal layer may be made of a magnetic metal material having iron as a main component. Thus, the magnetism and conductivity of the magnetic metal material can be utilized by the lower yoke, and terminal electrodes, respectively.

In the present invention, the substrate may have a through hole formed at a position overlapping the lower yoke, the magnetic rotator may include a ferrite core, and the ferrite core may be inserted into the through hole so as to overlap the lower yoke. With this configuration, the substrate is not interposed between the magnetic rotator and the lower yoke, allowing higher magnetic characteristics to be obtained. In addition, the ferrite core is inserted into the through hole, allowing the height of the non-reciprocal circuit element to be reduced.

In this case, the magnetic rotator may further include a laminated structure body having a plurality of center conductors and a plurality of insulating layers which are laminated alternately and having, on one surface thereof, a plurality of connection patterns connected to the plurality of center conductors, a plurality of wiring patterns may be formed on the upper surface of the substrate, and the laminated structure body may be mounted on the upper surface of the substrate such that it covers the through hole and that the plurality of connection patterns and the plurality of wiring patterns are mutually connected. With this configuration, the laminated structure body including the center conductor can be surface-mounted on the substrate, thus allowing reduction in manufacturing cost.

Further, in this case, the laminated structure body may include a first insulating layer, a first center conductor formed on one surface of the first insulating layer, a second center conductor formed on the other surface of the first insulating layer, a second insulating layer laminated on the first insulating layer so as to cover the second center conductor, a third center conductor formed on the surface of the second insulating layer, and first, second, and third connection patterns formed on the one surface of the first insulating layer and connected respectively to one ends of the first, second, and third center conductors, the plurality of wiring patterns may include first, second, and third wiring patterns connected respectively to the first, second, and third connection patterns, and the plurality of terminal electrodes may include first, second, and third terminal electrodes connected respectively to the first, second, and third wiring patterns. This eliminates the need for a process of folding the center conductor and thus allows a further reduction in manufacturing cost. In addition, the three center conductors are each formed on the surface of the insulating layer, enhancing pattern accuracy and allowing a plurality of the laminated structure bodies to be collectively produced at a time using an aggregate substrate.

Further, in this case, the laminated structure body may further include fourth, fifth, and sixth connection patterns formed on the one surface of the first insulating layer and connected respectively to the other ends of the first, second, and third center conductors, the plurality of wiring patterns may include fourth, fifth, and sixth wiring patterns connected respectively to the fourth, fifth, and sixth connection patterns, and the lower yoke may be connected to the fourth, fifth, and sixth wiring patterns. With this configuration, the lower yoke can be used as a ground terminal.

Further, in this case, the non-reciprocal circuit element may further include first, second, and third capacitors mounted on the upper surface of the substrate, and the lower yoke may be connected to the first, second, and third wiring patterns respectively through the first, second, and third capacitors. With this configuration, a predetermined capacitance can be given to the first, second, and third terminal electrodes.

The non-reciprocal circuit element according to the present invention may further include an upper yoke that covers the upper surface of the substrate so as to house therein the magnetic rotator and the permanent magnet, and the upper yoke may be fixed to the lower yoke. With this configuration, the magnetic rotator and the permanent magnet can be housed in a space formed between the substrate having the lower yoke thereon and the upper yoke.

In this case, the upper yoke may include a top plate part that covers the magnetic rotator and the permanent magnet from the upper side and first and second side plate parts that face each other and cover the magnetic rotator and the permanent magnet from the side, the end portion of the first side plate part may be fixed to one end of the lower yoke, and the end portion of the second side plate part may be connected to the other end of the lower yoke. With this configuration, a magnetic circuit can be constituted by the upper and lower yokes.

Further, in this case, the upper yoke may further include third and fourth side plate parts that face each other and cover the magnetic rotator and the permanent magnet from the side, and the third and fourth side plate parts may have first and second plate spring parts that sandwich the permanent magnet and bias it. With this configuration, the permanent magnetic before magnetization can be held inside the upper yoke, thus eliminating the need for a tentative magnetization process which is performed for preventing coming-off of the non-magnetized permanent magnet.

As described above, according to the present invention, in the non-reciprocal circuit element of a surface mount type having a structure in which the magnetic rotator is mounted on the substrate, the shape of the substrate is simplified, thus allowing reduction in manufacturing cost.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
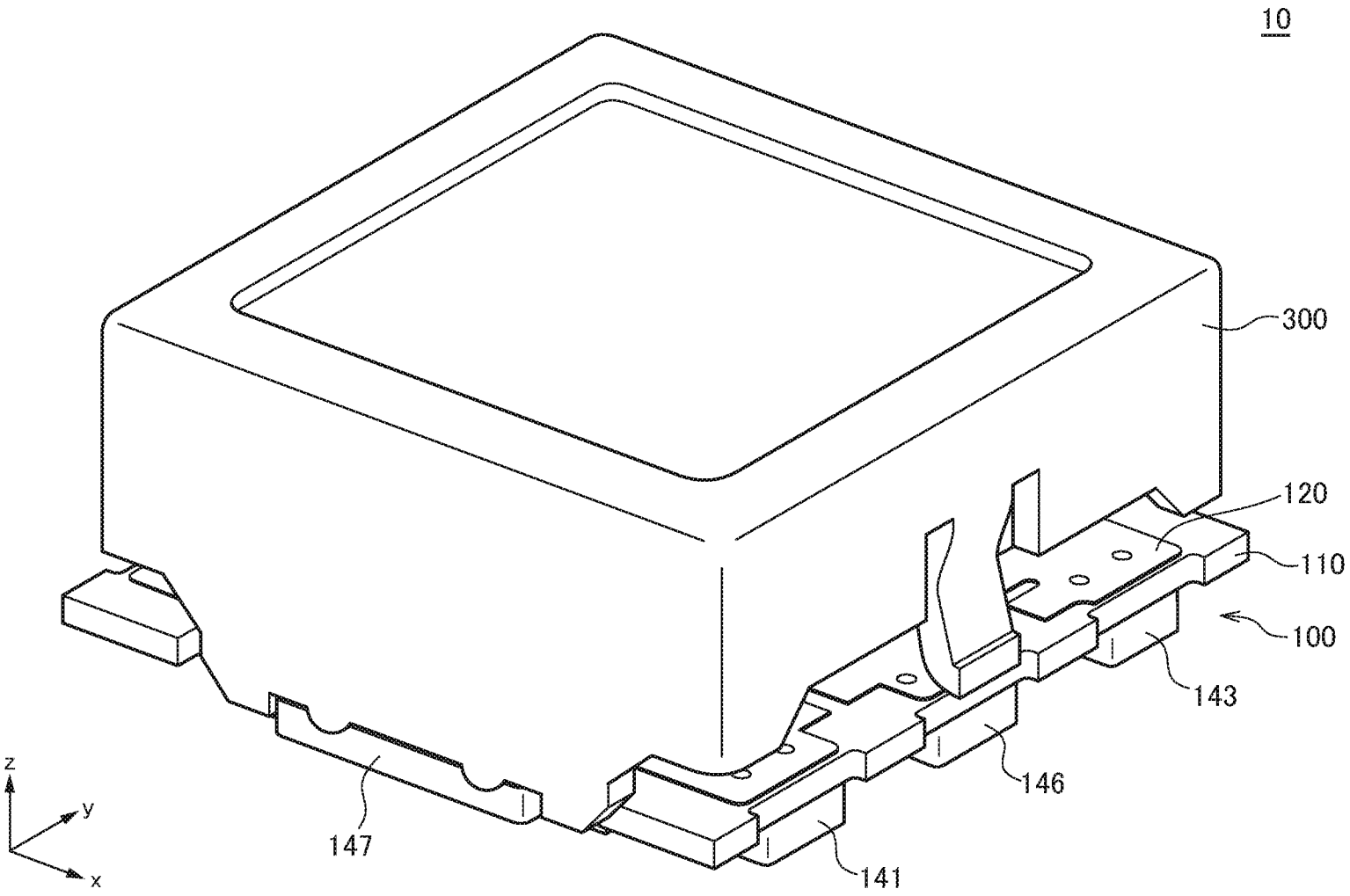
FIG. 1 is a schematic perspective view seen from the upper side illustrating the outer appearance of a non-reciprocal circuit element according to a preferred embodiment of the present invention.
Figure 2:
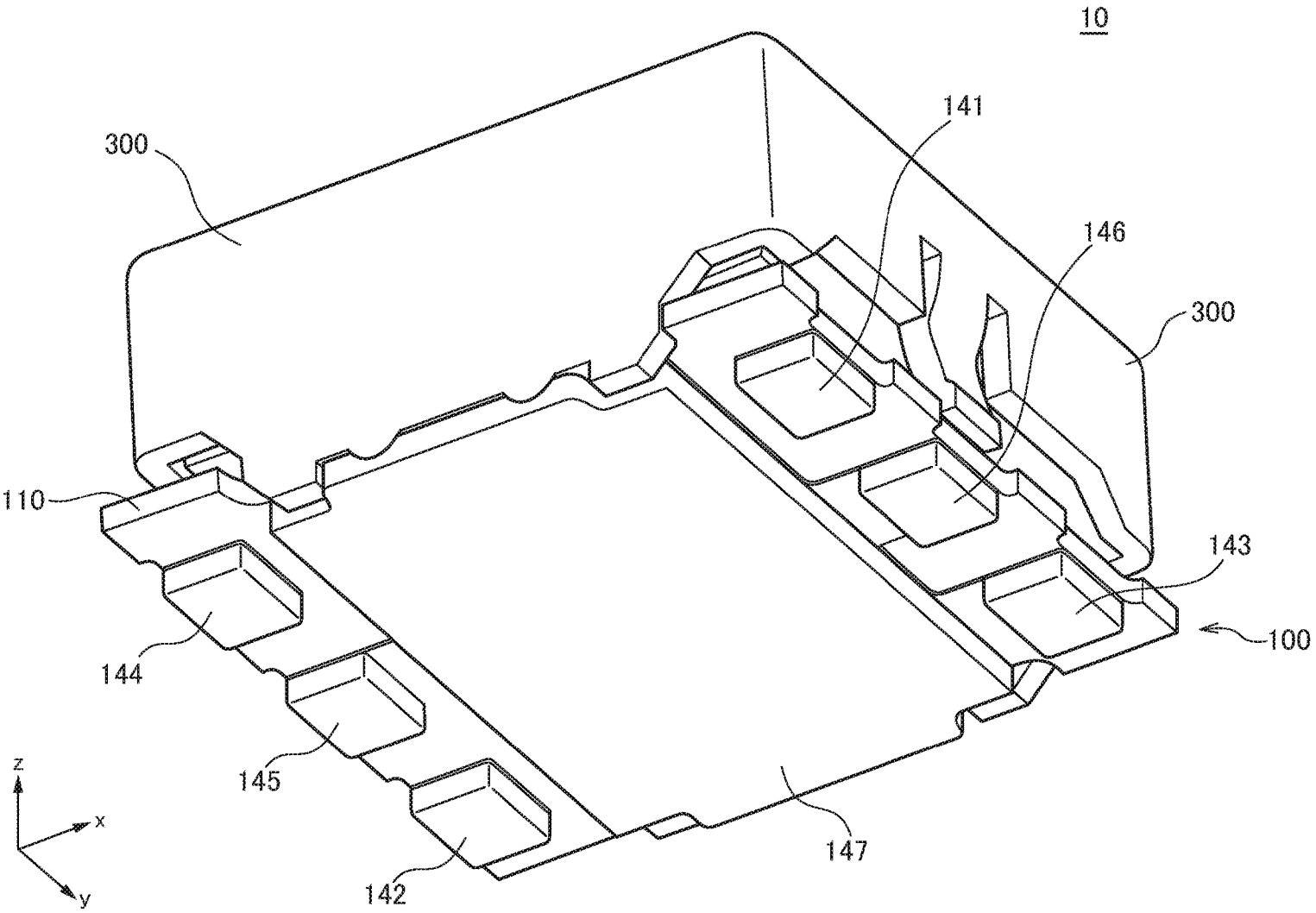
FIG. 2 is a schematic perspective view seen from the lower side illustrating the outer appearance of the non-reciprocal circuit element shown in FIG. 1.
Figure 3:
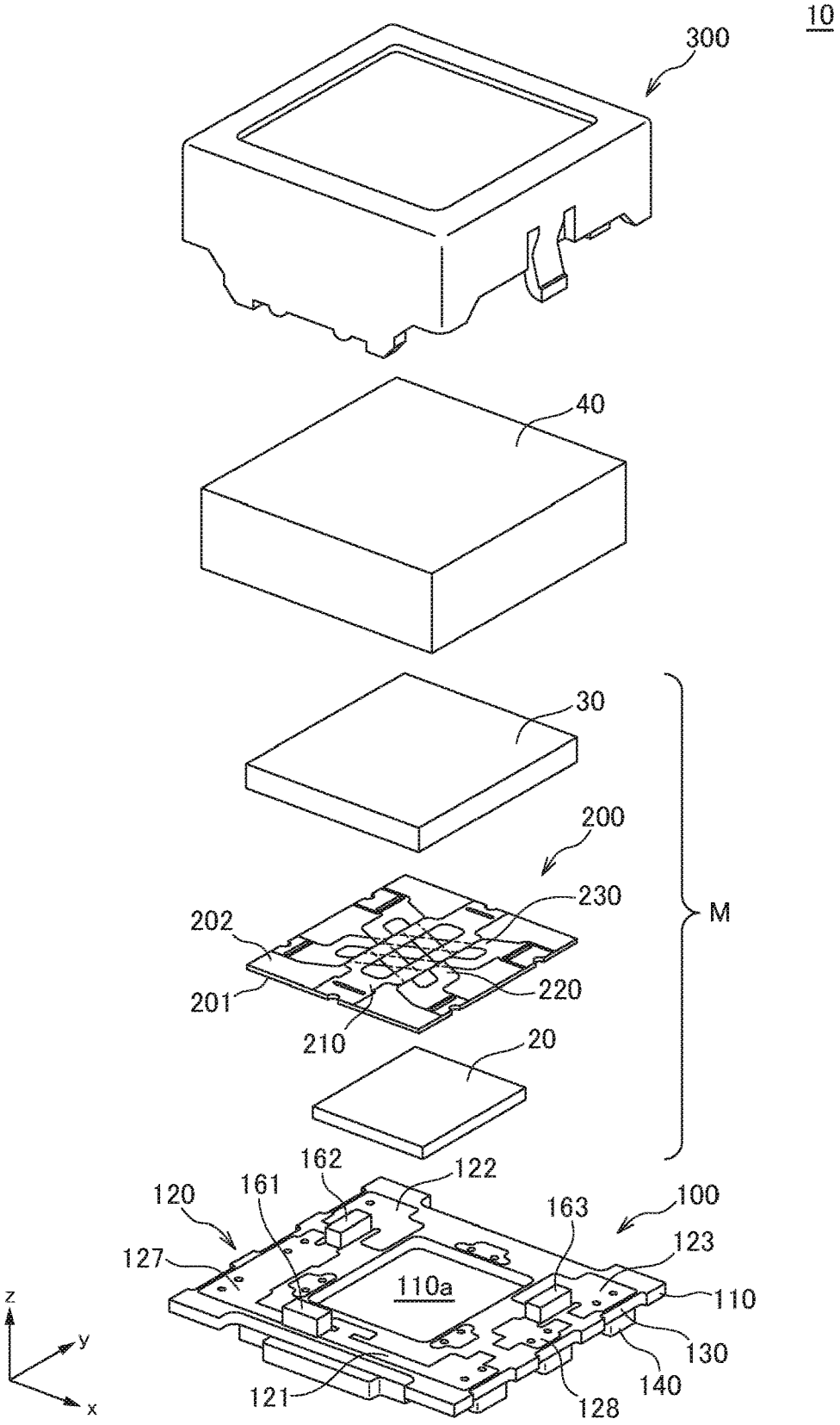
FIG. 3 is a schematic exploded perspective view for explaining the configuration of the non-reciprocal circuit element shown in FIG. 1.

FIGS. 1 and 2 are schematic perspective views illustrating the outer appearance of a non-reciprocal circuit element 10 according to a preferred embodiment of the present invention. FIG. 1 is a view seen from the upper side, and FIG. 2 is a view seen from the lower side. FIG. 3 is a schematic exploded perspective view for explaining the configuration of the non-reciprocal circuit element 10 according to the present embodiment.

The non-reciprocal circuit element 10 according to the present embodiment is a non-reciprocal circuit element of a surface mount type and includes, as illustrated in FIGS. 1 to 3, a circuit board part 100, a laminated structure body 200, ferrite cores 20 and 30, a permanent magnet 40, and a case-shaped upper yoke 300. As illustrated in FIG. 3, the laminated structure body 200 has a structure in which center conductors 210, 220, and 230 are laminated through insulating layers 201 and 202 and vertically sandwiched by the ferrite cores 20 and 30 to constitute a magnetic rotator M. The permanent magnet 40 is positioned above the ferrite core 30. After the magnetic rotator M and permanent magnet 40 are mounted on the circuit board part 100, the upper yoke 300 is fixed onto the circuit board part 100, whereby the magnetic rotator M and permanent magnet 40 are housed in a space formed between the circuit board part 100 and the upper yoke 300.

As illustrated in FIG. 3, the xy plane size of the upper ferrite core 30 is the same as the xy plane size of the laminated structure body 200. On the other hand, the xy plane size of the lower ferrite core 20 is smaller than the xy plane size of the laminated structure body 200 and is configured to be inserted into a through hole 110*a* formed in the circuit board part 100. The thickness (z-direction size) of the ferrite core 20 is substantially the same as the depth (z-direction size) of the through hole 110*a* and thus, the ferrite core 20 does not protrude from the circuit board part 100 in a state of being inserted into the through hole 110*a*. On the other hand, the xy plane size of the laminated structure body 200 is larger than the xy plane size of the through hole 110*a*, thus allowing the laminated structure body 200 to be surface-mounted on the circuit board part 100.

However, in the present invention, the magnetic rotator M may not necessarily have both the ferrite cores 20 and 30, and one of the ferrite cores 20 and 30 may be omitted. Further, the ferrite core 20 may not necessarily be inserted into the through hole 110*a*, and it may be placed on the circuit board part 100. However, in this case, a connection pattern of the laminated structure body 200 needs to extend in the z-direction, for example, so as to be connected to the circuit board part 100. On the other hand, when the ferrite core 20 is accommodated in the through hole 110*a* as in the present embodiment, the laminated structure body 200 can be surface-mounted on the circuit board part 100, allowing not only reduction in manufacturing cost but also simplification of the structure of the laminated structure body 200.

Figure 4:
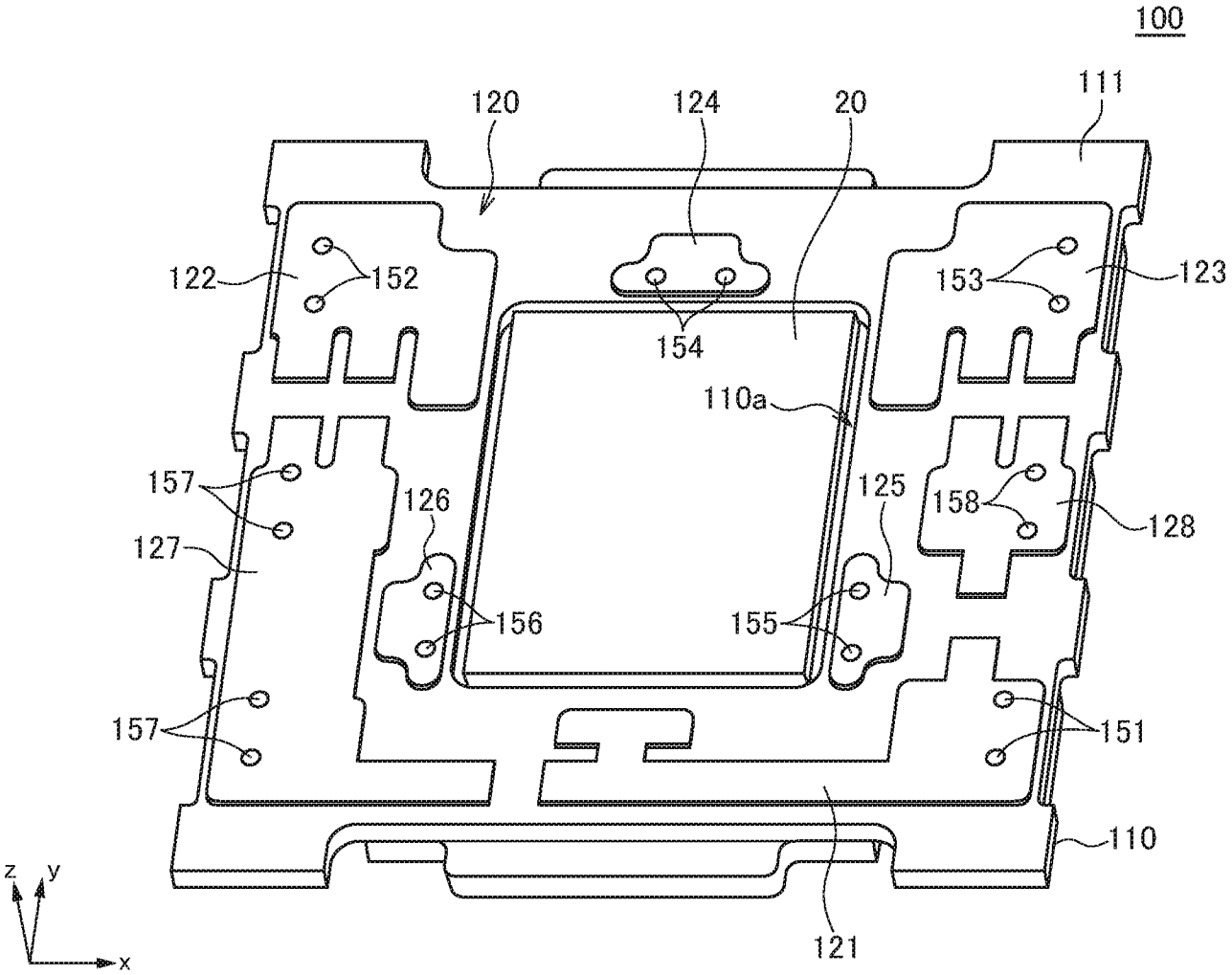
FIG. 4 is a schematic perspective view for explaining the structure of a circuit board part as viewed from above.
Figure 5:
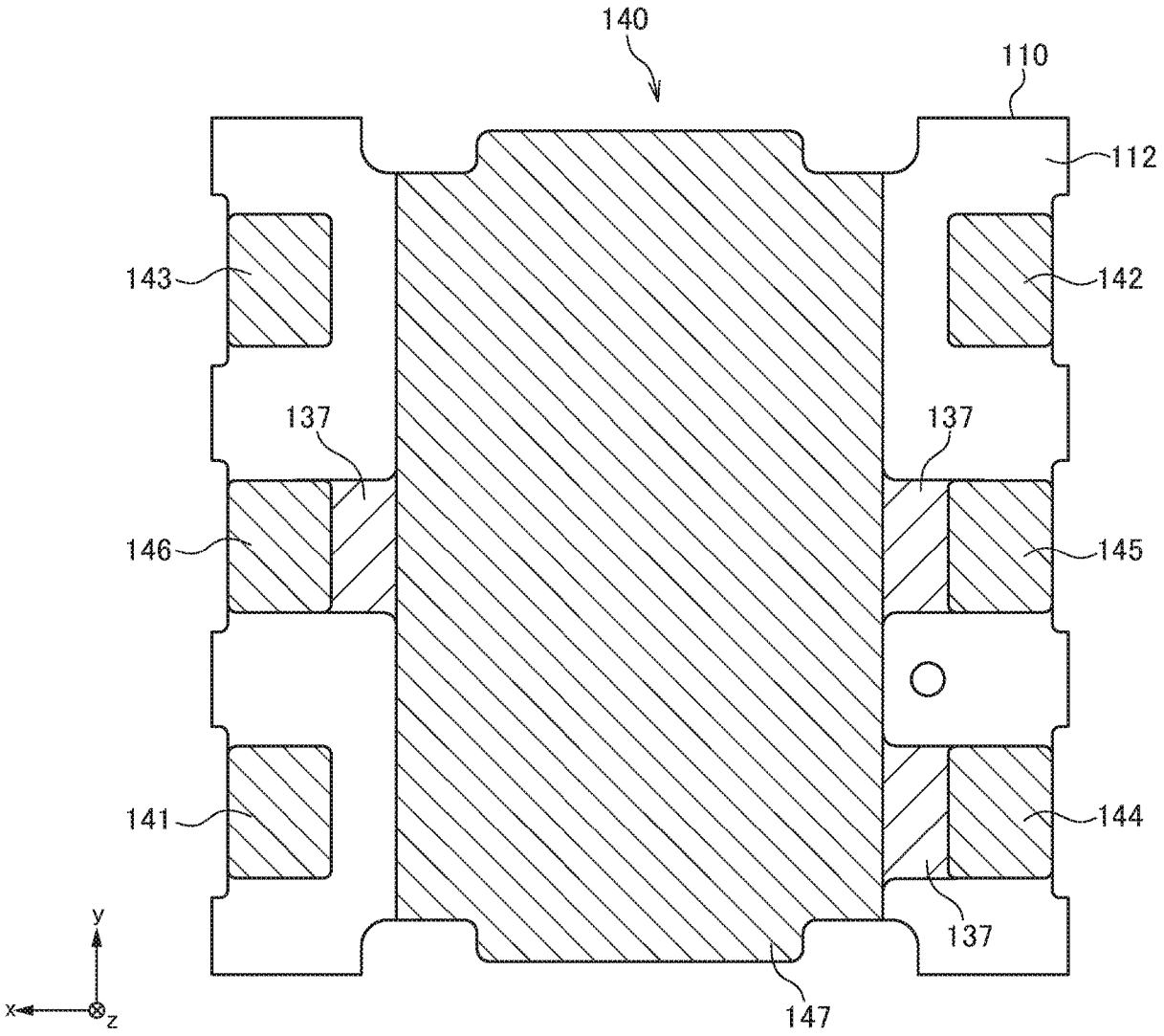
FIG. 5 is a schematic plan view of the circuit board part as view from below.

FIG. 4 is a schematic perspective view for explaining the structure of the circuit board part 100 as viewed from above. FIG. 5 is a schematic plan view of the circuit board part 100 as view from below. In FIG. 4, the ferrite core 20 is inserted into the through hole 110*a*.

Figure 6:
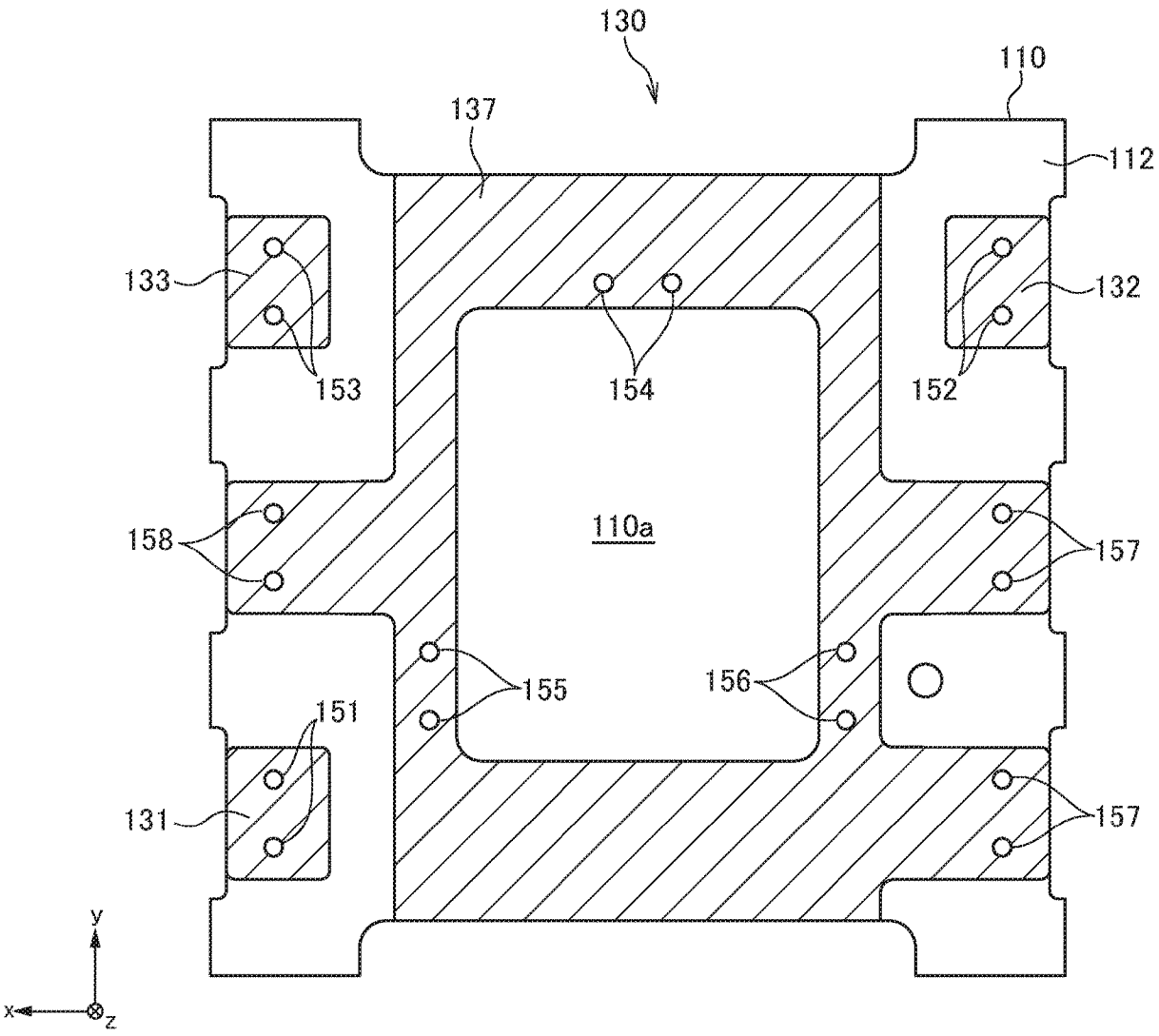
FIG. 6 is a schematic plan view for illustrating a state where the magnetic metal layer is omitted from the circuit board part.

As illustrated in FIGS. 4 and 5, the circuit board part 100 includes a substrate 110 made of an insulating material such as resin, a wiring layer 120 formed on an upper surface 111 of the substrate 110, and a magnetic metal layer 140 formed on a lower surface 112 of the substrate 110. FIG. 6 illustrates a state where the magnetic metal layer 140 is omitted. As illustrated in FIG. 6, another wiring layer 130 is provided on the lower surface 112 of the substrate 110. The wiring layer 130 is positioned in the lower layer of the magnetic metal layer 140.

As illustrated in FIG. 4, the wiring layer 120 has a plurality of wiring patterns 121 to 128. Further, as illustrated in FIG. 6, the wiring layer 130 has a plurality of wiring patterns 131 to 133 and 137. The wiring patterns 121 to 128 are formed by patterning a metal foil made of copper (Cu) or the like formed on the upper surface 111 of the substrate 110. Similarly, the wiring patterns 131 to 133 and 137 are formed by patterning a metal foil made of copper (Cu) or the like formed on the lower surface 112 of the substrate 110.

As illustrated in FIG. 5, the magnetic metal layer 140 has terminal electrodes 141 to 146 and a lower yoke 147. The terminal electrodes 141 to 146 and lower yoke 147 are each made of a magnetic metal material having, for example, iron as a main component and are, for example, bonded to the surface of the wiring layer 130. The magnetic metal layer 140 including the lower yoke 147 needs to have a sufficient thickness and is designed to be thicker than the wiring layers 120 and 130. When the magnetic metal layer 140 is made of a magnetic metal material having iron as a main component, the surface of the magnetic metal layer 140 is preferably covered with a nickel (Ni) plated film and a copper (Cu) plated film in order to prevent corrosion. In this case, the nickel-plated film is positioned between the magnetic metal material and the copper plated film to enhance adhesion between them and function as a barrier metal. When the copper (Cu) plated film is positioned in the outermost layer, high frequency resistance of the magnetic metal layer 140 can be reduced by skin effect.

The circuit board part 100 has via conductors 151 to 158 penetrating the substrate 110. As illustrated in FIGS. 4 and 6, the via conductor 151 connects the wiring pattern 121 and the wiring pattern 131, the via conductor 152 connects the wiring pattern 122 and the wiring pattern 132, and the via conductor 153 connects the wiring pattern 123 and the wiring pattern 133. The via conductors 154 to 158 connect the wiring patterns 124 to 128 and the wiring pattern 137, respectively.

As illustrated in FIG. 5, the terminal electrodes 141 to 143 are provided so as to overlap the wiring patterns 131 to 133, respectively. The terminal electrodes 144 to 146 and lower yoke 147 are provided so as to overlap the wiring pattern 137. Accordingly, the terminal electrodes 144 to 146 and lower yoke 147 have the same potential and are applied with a ground potential in actual use. The lower yoke 147 covers the through hole 110*a* and has both ends in the y-direction protruding from the substrate 110.

Figure 7:
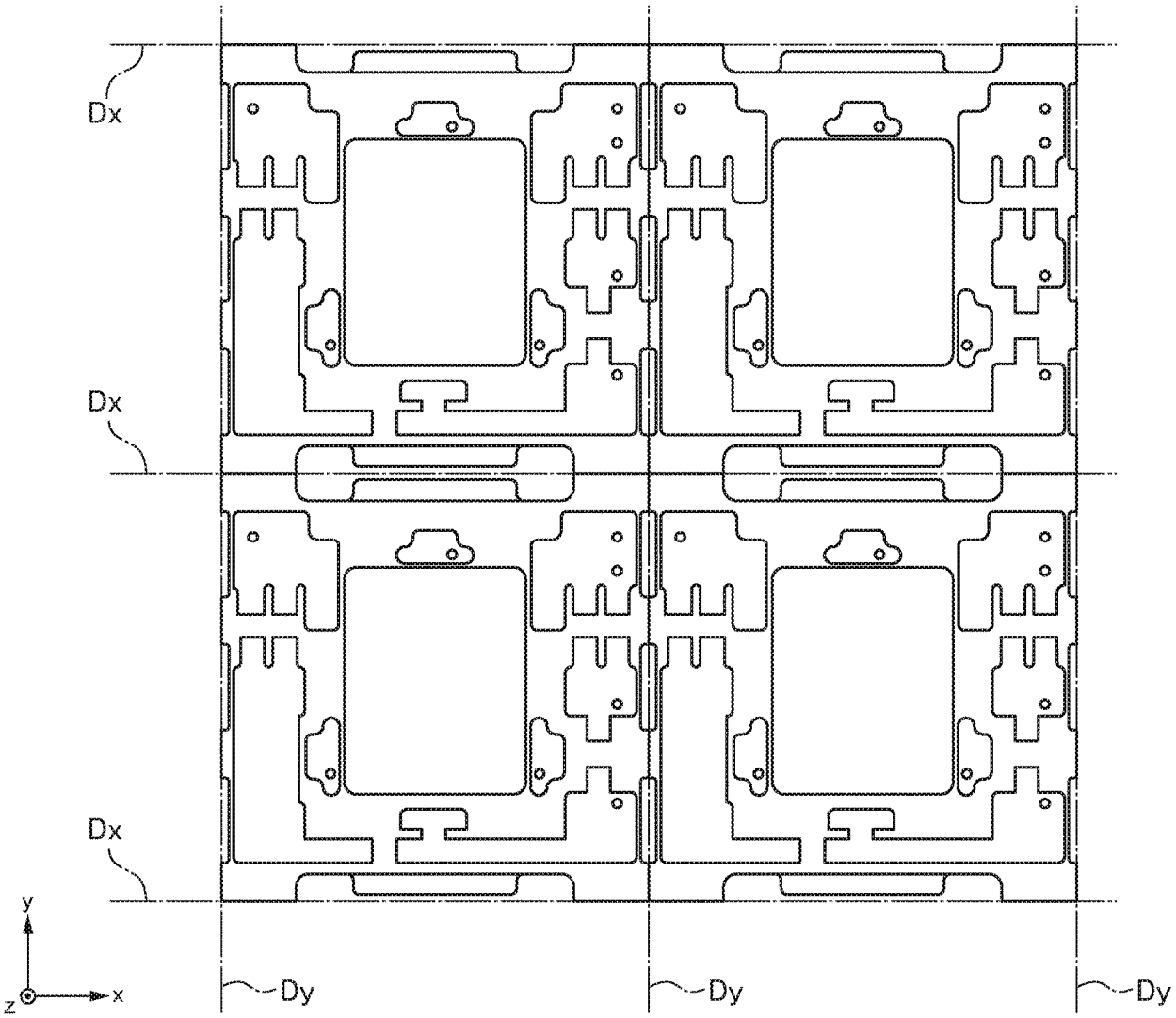
FIG. 7 is a schematic plan view for illustrating an aggregate substrate.

Although the circuit board part 100 may be produced individually, a plurality of the circuit board parts 100 are preferably collectively produced at a time. In this case, an aggregate substrate 100A illustrated in FIG. 7 is produced, and is then cut along a dicing line Dx extending in the x-direction and a dicing line Dy extending in the y-direction.

Figure 8:
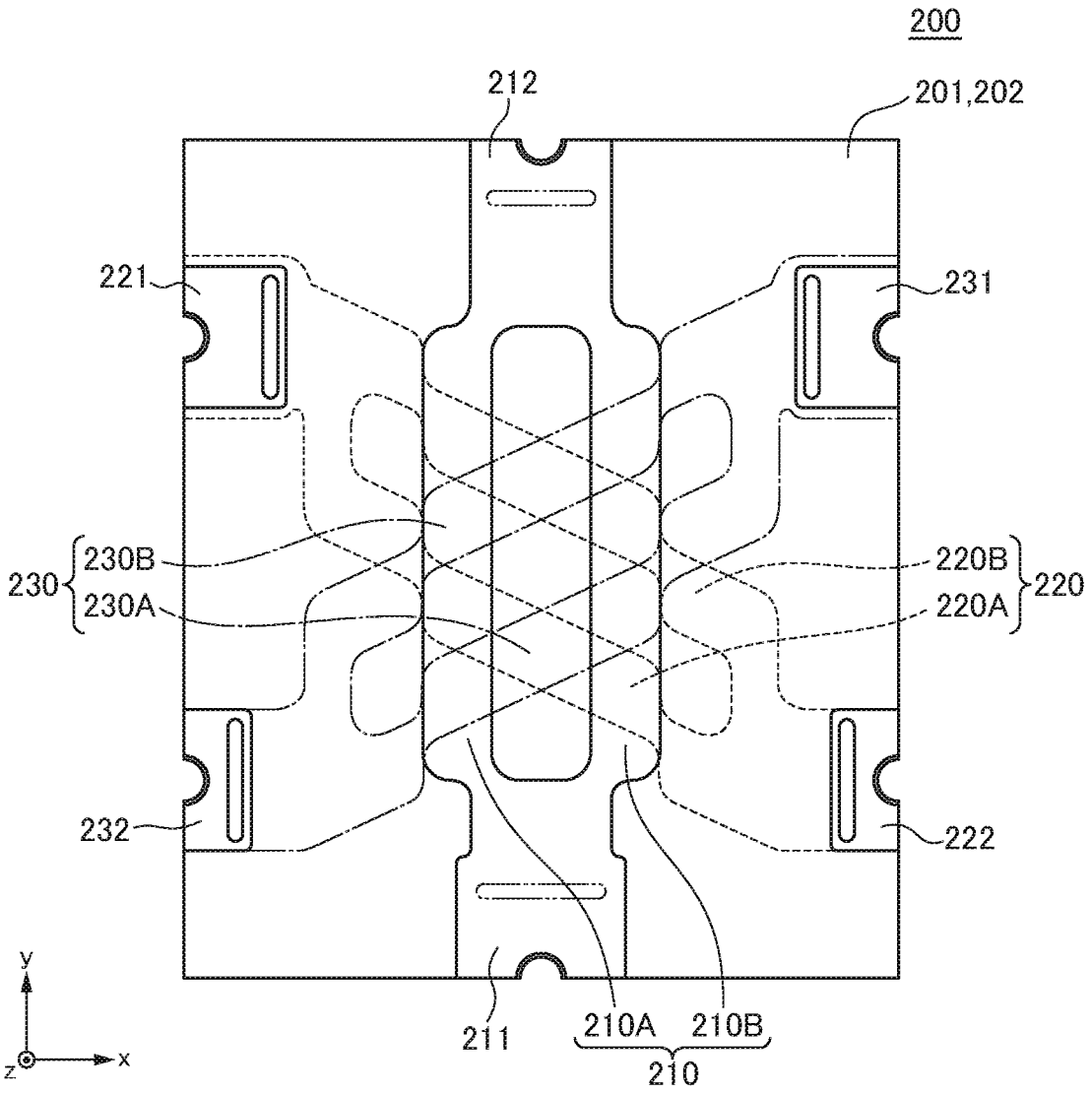
FIG. 8 is a transparent plan view for explaining the structure of a laminated structure body.
Figure 9:
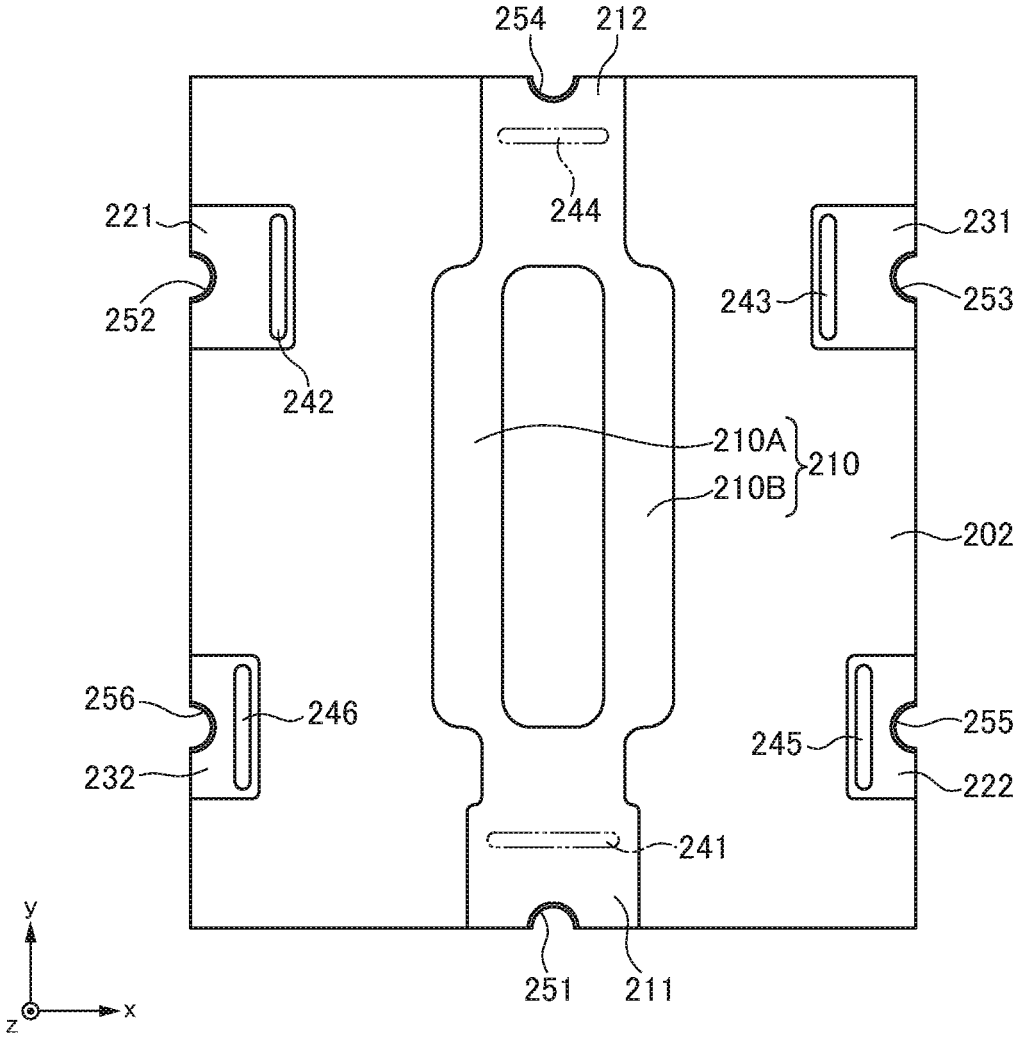
FIG. 9 is a plan view for explaining the structure of the laminated structure body.

FIGS. 8 and 9 are a transparent plan view and a plan view for explaining the structure of the laminated structure body 200.

As illustrated in FIG. 8, the laminated structure body 200 has a structure in which the center conductors 210, 220, and 230 are laminated through the insulating layers 201 and 202 made of a resin material. As illustrated in FIG. 9, the center conductor 210 includes two strip patterns 210A and 210B provided on the upper surface of the insulating layer 202 and extends from the 6 o'clock position to the 12 o'clock position. One end of the center conductor 210 is connected to a connection pattern 211, and the other end thereof is connected to a connection pattern 212.

Figure 10:
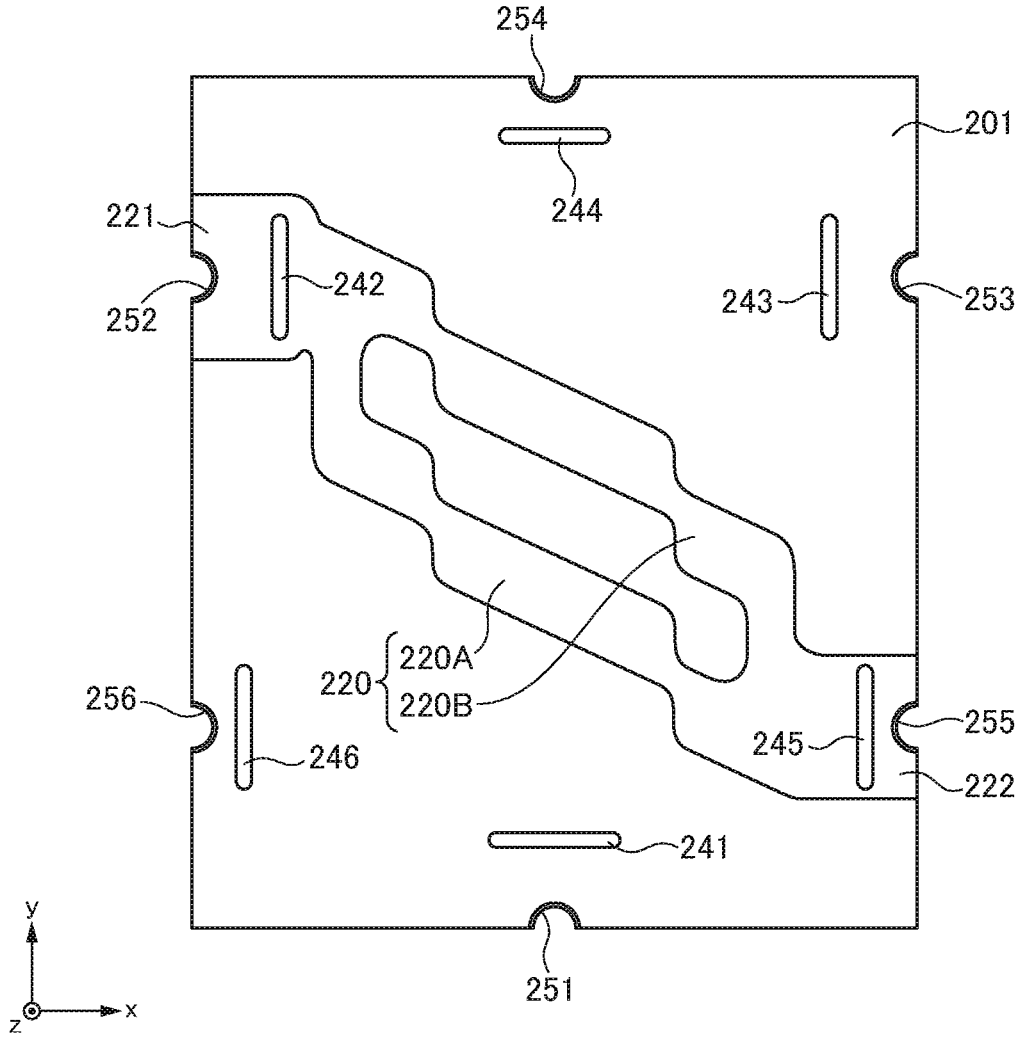
FIG. 10 is a plan view illustrating a state where the center conductor and the insulating layer are removed from the laminated structure body.

FIG. 10 is a plan view illustrating a state where the center conductor 210 and the insulating layer 202 are removed from the laminated structure body 200. As illustrated in FIG. 10, the center conductor 220 includes two strip patterns 220A and 220B provided on the upper surface of the insulating layer 201 and extends from the 10 o'clock position to the 4 o'clock position. One end of the center conductor 220 is connected to a connection pattern 221, and the other end thereof is connected to a connection pattern 222.

Figure 11:
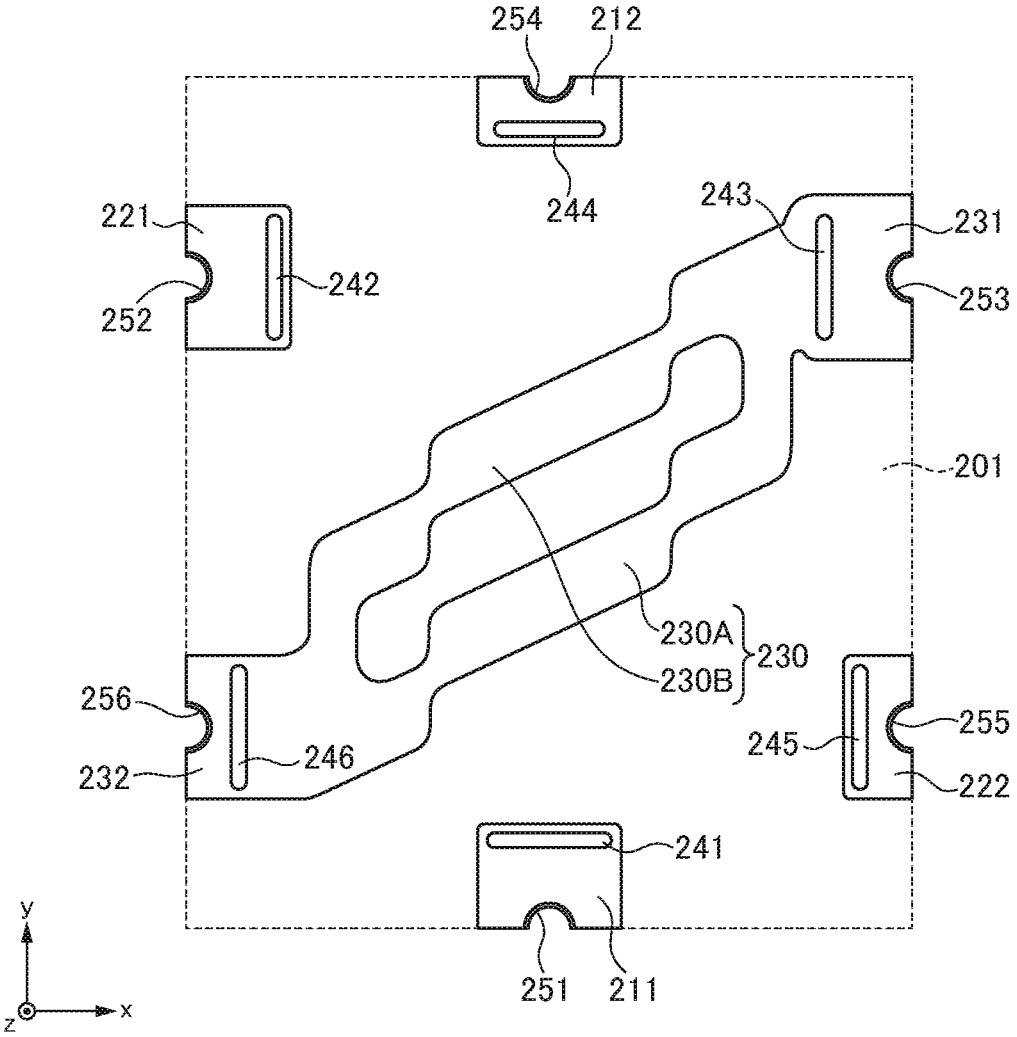
FIG. 11 is a plan view illustrating a state where the center conductors and insulating layers are removed from the laminated structure body.

FIG. 11 is a plan view illustrating a state where the center conductors 210, 220 and insulating layers 201, 202 are removed from the laminated structure body 200. As illustrated in FIG. 11, the center conductor 230 includes two strip patterns 230A and 230B provided on the lower surface of the insulating layer 201 and extends from the 2 o'clock position to the 8 o'clock position. One end of the center conductor 230 is connected to a connection pattern 231, and the other end thereof is connected to a connection pattern 232.

The above-mentioned connection patterns 211, 212, 221, 222, 231, and 232 are connected respectively to the via conductors 241 to 246 penetrating the insulating layers 201 and 202 and side conductors 251 to 256 provided on the side surfaces of the insulating layers 201 and 202. As a result, the connection patterns 211, 212, 221, 222, 231, and 232 are led to the lower surface of the insulating layer 201. The lower surface of the insulating layer 201 constitutes one surface of the laminated structure body 200.

The thus configured laminated structure body 200 can be surface-mounted on the circuit board part 100. When the laminated structure body 200 is mounted on the circuit board part 100, the connection patterns 211, 212, 221, 222, 231, and 232 are connected respectively to the wiring patterns 121 to 126. As a result, one ends of the center conductors 210, 220, and 230 are connected respectively to the terminal electrodes 141 to 143 through the wiring patterns 121 to 123, respectively. Further, the other ends of the center conductors 210, 220, and 230 are connected in common to the terminal electrodes 144 to 146 and lower yoke 147 through the wiring patterns 124 to 126, respectively.

Figure 13:
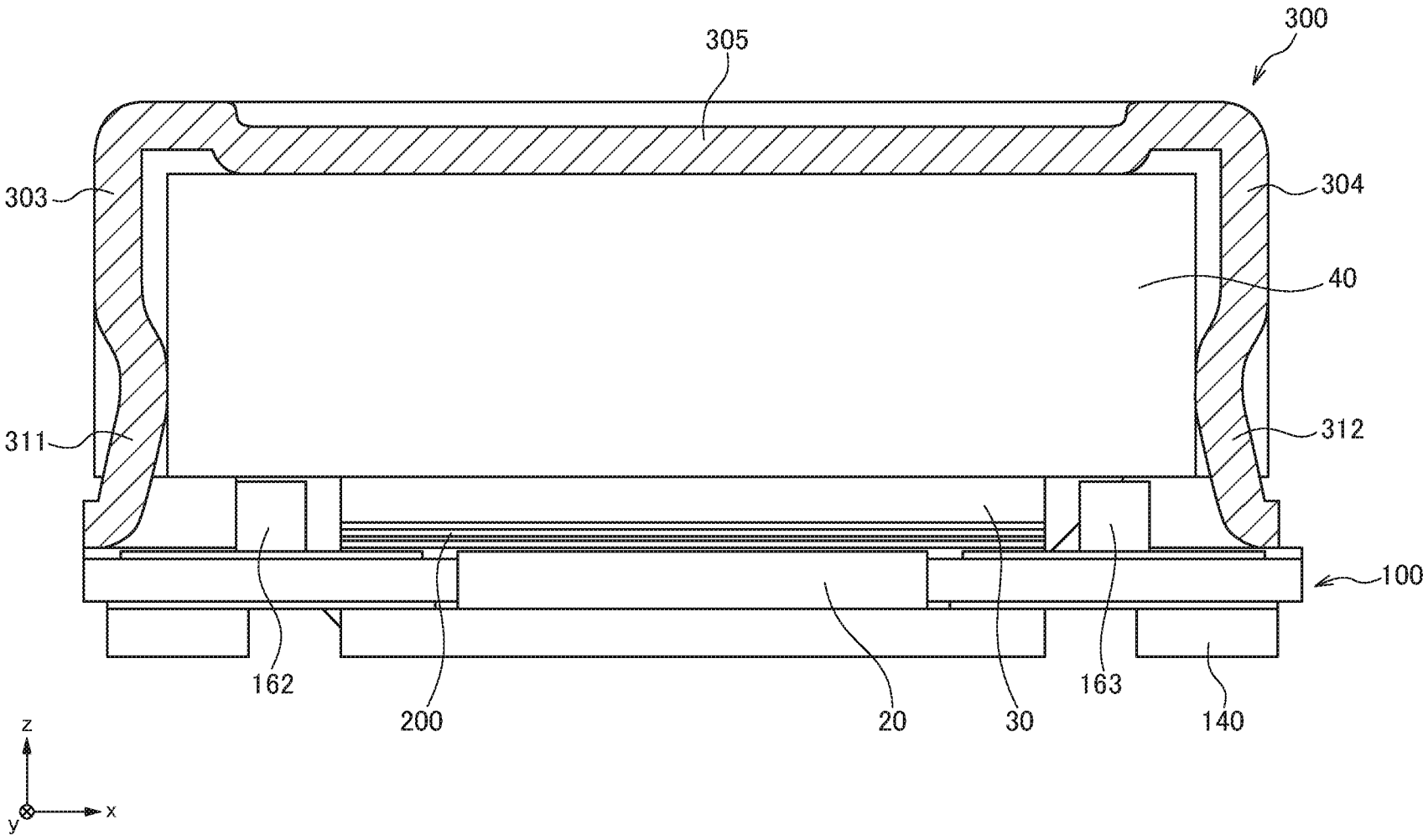
FIG. 13 is a xz-sectional view of the non-reciprocal circuit element.

Further, as illustrated in FIG. 3, a chip type capacitor 161 is connected between the wiring patterns 121 and 127, a chip type capacitor 162 is connected between the wiring patterns 122 and 127, and a chip type capacitor 163 is connected between the wiring patterns 123 and 128. As a result, one ends of the center conductors 210, 220, and 230 are connected to the ground through the capacitors 161 to 163. When the height of each of the capacitors 161 to 163 is smaller than the total thicknesses of the laminated structure body 200 and ferrite core 30, the capacitors 161 to 163 can be disposed between the substrate 110 and the permanent magnet 40, as illustrated in FIG. 13.

Figure 12:
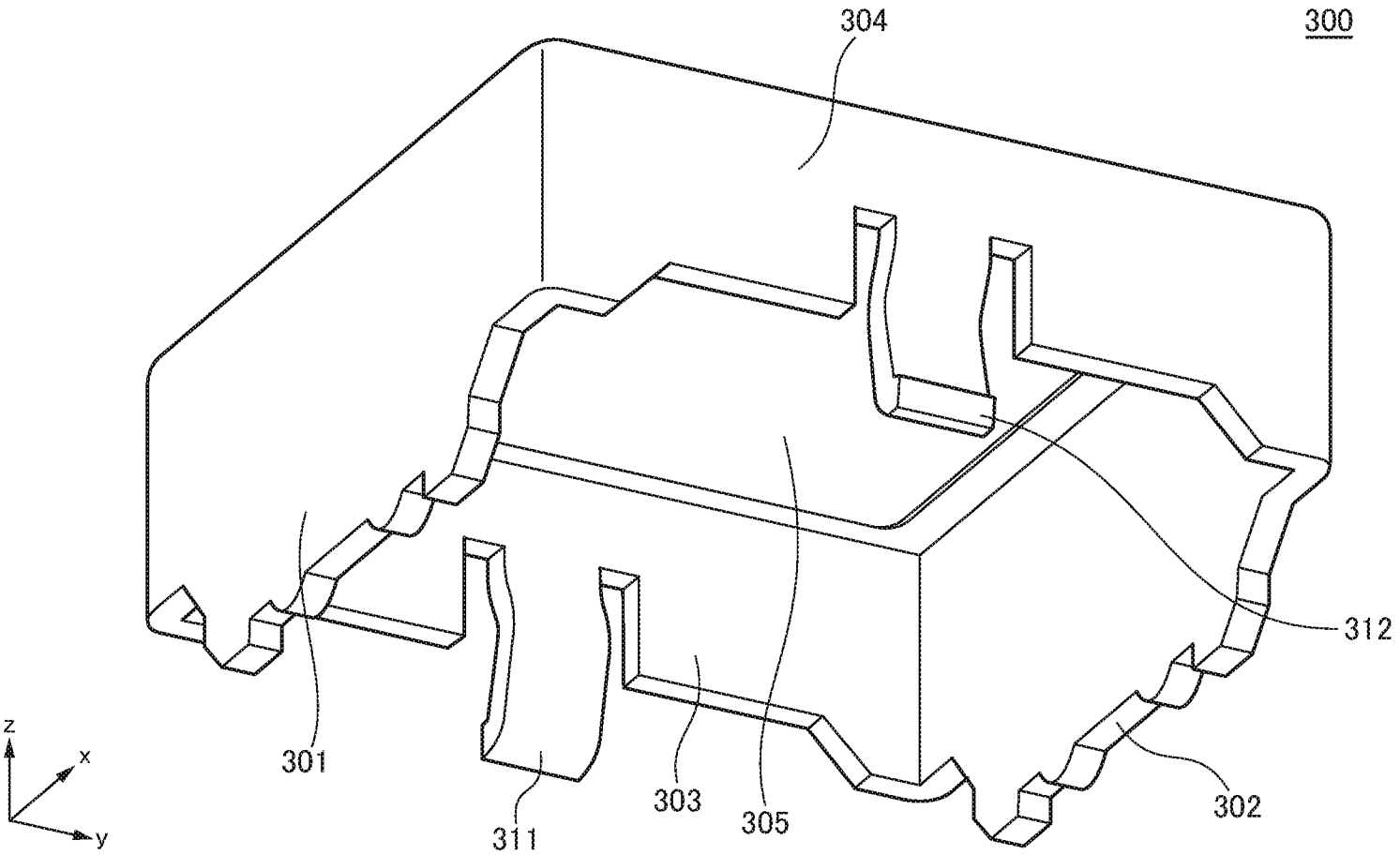
FIG. 12 is a schematic perspective view for explaining the structure of the upper yoke.

FIG. 12 is a schematic perspective view for explaining the structure of the upper yoke 300.

As illustrated in FIG. 12, the upper yoke 300 includes a top plate part 305 that covers the magnetic rotator M and the permanent magnet 40 from the upper side, and side plate parts 301 to 304 that cover the magnetic rotator M and the permanent magnet 40 from the side. The top plate part 305 constitutes the xy plane, side plate parts 301 and 302 constitute the xz plane and face each other, and the side plate parts 303 and 304 constitute the yz plane and face each other. As illustrated in FIGS. 1 and 2, end portions of the side plate parts 301 and 302 of the upper yoke 300 are fixed respectively to one and the other ends of the lower yoke 147 in the y-direction. The upper yoke 300 and the lower yoke 147 can be fixed to each other by welding. As a result, the upper yoke 300 and lower yoke 147 constitute a magnetic circuit, and the magnetic rotator M and permanent magnet 40 are fixed and housed between the circuit board part 100 and the upper yoke 300.

The side plate parts 303 and 304 of the upper yoke 300 have plate spring parts 311 and 312, respectively. The plate spring parts 311 and 312 are slightly bent inward from the main bodies of the side plate parts 303 and 304 such that the interval between the inner wall of the plate spring part 311 and the inner wall of the plate spring part 312 in the x-direction is slightly smaller than the width of the permanent magnet 40 in the x-direction. It follows that, when the permanent magnet 40 is housed in the upper yoke 300, it is biased by the plate spring parts 311 and 312 from both sides in the x-direction, as illustrated in FIG. 13 which is an xz cross-sectional view of the non-reciprocal circuit element 10. Thus, when the permanent magnet 40 before magnetization is housed in the upper yoke 300 in an assembly process of the non-reciprocal circuit element 10, it is held inside the upper yoke 300 by the biasing from the plate spring parts 311 and 312, thus preventing the permanent magnet 40 from coming off from the upper yoke 300 even when the permanent magnet 40 is oriented in the gravity direction. This eliminates the need to perform a tentative magnetization process, which is a process for preventing the permanent magnet 40 from coming off, and hence allows a further reduction in manufacturing cost.

In a manufacturing process of the non-reciprocal circuit element 10, the magnetic rotator M is mounted on the circuit board part 100, and the non-magnetized permanent magnet 40 is housed inside the upper yoke 300 with the top plate part 305 of the upper yoke 300 facing downward (the gravity direction). Then, the upper yoke 300 is turned upside down and attached to the circuit board part 100, and end portions of the side plate parts 301 and 302 are fixed to the lower yoke 147 by welding or the like. Finally, the permanent magnet 40 is magnetized, whereby the non-reciprocal circuit element 10 is completed. If the upper yoke 300 does not have the plate spring parts 311 and 312 and is a simple lid-shaped body, the non-magnetized permanent magnet 40 comes off from the upper yoke 300 due to gravity when the upper yoke 300 is tuned upside down. To prevent this, the permanent magnet 40 needs to be tentatively magnetized to such an extent that it does not come off due to gravity; however, in this case, the tentative magnetization process needs to be added.

Nonetheless, in the non-reciprocal circuit element 10 according to the present embodiment, the upper yoke 300 has the plate spring parts 311 and 312, and the permanent magnet 40 is held inside the upper yoke 300 by the biasing from the plate spring parts 311 and 312. This structure therefore eliminates the need to perform the tentative magnetization, allowing reduction in the number of processes.

As described above, in the non-reciprocal circuit element 10 according to the present embodiment, the magnetic metal layer 140 is formed on the lower surface 112 of the substrate 110 constituting the circuit board part 100, and a part of the magnetic metal layer 140 is used as the terminal electrodes (141 to 146) and the remaining part thereof is used as the lower yoke 147, thus eliminating the need to adopt a structure in which the lower yoke 147 goes around to the lower surface of the substrate from the side surface thereof. This eliminates a highly sophisticated machining process that includes locally thinning the thickness of the substrate, thereby allowing reduction in manufacturing cost. In addition, the terminal electrodes 141 to 146 and the lower yoke 147 constitute the same plane, so that when the non-reciprocal circuit element 10 is mounted on a motherboard, no interference occurs between the lower yoke 147 and the motherboard.

Further, in the present embodiment, the through hole 110*a* is formed in the circuit board part 100, and the ferrite core 20 is accommodated in the through hole 110*a*, allowing the laminated structure body 200 constituting the magnetic rotator M to be surface-mounted on the circuit board part 100, which can further reduce manufacturing cost. In addition, the laminated structure body 200 has a structure in which a conductor pattern constituting the center conductors 210, 220, and 230 is formed on the insulating layers 201 and 202, unlike a conventional structure obtained by folding a center conductor. Owing such a structure, a plurality of the laminated structure bodies 200 can be easily and collectively produced at a time using an aggregate substrate in the same way as a typical multilayer substrate.

Further, in the present embodiment, the upper yoke 300 has the plate spring parts 311 and 312, and the permanent magnet 40 is held inside the upper yoke 300 by the biasing from the plate spring parts 311 and 312. This eliminates the need to perform the tentative magnetization in the assembly process.

It is apparent that the present invention is not limited to the above embodiments, but may be modified and changed without departing from the scope and spirit of the invention.

What is claimed is:

1. A non-reciprocal circuit element comprising:

a substrate having a lower surface and an upper surface, the upper surface having a plurality of wiring patterns formed thereon;

a magnetic metal layer provided on the lower surface of the substrate;

a magnetic rotator provided on the upper surface of the substrate, the magnetic rotator including a ferrite core and a laminated structure body in which a plurality of center conductors and a plurality of insulating layers are alternately laminated, and a permanent magnet for applying a magnetic field to the magnetic rotator, wherein the magnetic metal layer includes a lower yoke provided at a position overlapping the magnetic rotator in a plan view and a plurality of terminal electrodes connected to the magnetic rotator, wherein the substrate has a through hole formed at a position overlapping the lower yoke, wherein the ferrite core is inserted into the through hole so as to overlap the lower yoke, wherein the laminated structure body has, on one surface thereof, a plurality of connection patterns connected to the plurality of center conductors, and wherein the laminated structure body is mounted on the upper surface of the substrate such that the laminated structure body covers the through hole and such that the plurality of connection patterns and the plurality of wiring patterns are mutually connected.

2. The non-reciprocal circuit element as claimed in claim 1, wherein the magnetic metal layer is made of a magnetic metal material having iron as a main component.

3. The non-reciprocal circuit element as claimed in claim 1, wherein the laminated structure includes:

a first insulating layer;

a first center conductor formed on one surface of the first insulating layer;

a second center conductor formed on the other surface of the first insulating layer;

a second insulating layer laminated on the first insulating layer so as to cover the second center conductor;

a third center conductor formed on a surface of the second insulating layer; and first, second, and third connection patterns formed on the one surface of the first insulating layer and connected respectively to one ends of the first, second, and third center conductors, wherein the plurality of wiring patterns include first, second, and third wiring patterns connected respectively to the first, second, and third connection patterns, and wherein the plurality of terminal electrodes include first, second, and third terminal electrodes connected respectively to the first, second, and third wiring patterns.

4. The non-reciprocal circuit element as claimed in claim 3, wherein the laminated structure body further includes fourth, fifth, and sixth connection patterns formed on the one surface of the first insulating layer and connected respectively to the other ends of the first, second, and third center conductors, wherein the plurality of wiring patterns further include fourth, fifth, and sixth wiring patterns connected respectively to the fourth, fifth, and sixth connection patterns, and wherein the lower yoke is connected to the fourth, fifth, and sixth wiring patterns.

5. The non-reciprocal circuit element as claimed in claim 4, further comprising first, second, and third capacitors mounted on the upper surface of the substrate, wherein the lower yoke is connected to the first, second, and third wiring patterns respectively through the first, second, and third capacitors.

6. The non-reciprocal circuit element as claimed in claim 5, further comprising an upper yoke that covers the upper surface of the substrate so as to house therein the magnetic rotator and the permanent magnet, wherein the upper yoke is fixed to the lower yoke.

7. The non-reciprocal circuit element as claimed in claim 6, wherein the upper yoke includes a top plate part that covers the magnetic rotator and the permanent magnet from an upper side and first and second side plate parts that face each other and cover the magnetic rotator and the permanent magnet from a side, wherein an end portion of the first side plate part is fixed to one end of the lower yoke, and wherein an end portion of the second side plate part is connected to other end of the lower yoke.

8. The non-reciprocal circuit element as claimed in claim 7, wherein the upper yoke further includes third and fourth side plate parts that face each other and cover the magnetic rotator and the permanent magnet from the side, and wherein the third and fourth side plate parts have first and second plate spring parts that sandwich the permanent magnet and bias it.

* * * * *